US010112292B2

(12) United States Patent
Keng

(10) Patent No.: US 10,112,292 B2
(45) Date of Patent: Oct. 30, 2018

(54) MULTIPURPOSE HANDHELD TOOL AND ACCESSORIES

(71) Applicant: Shane Keng, Marietta, GA (US)

(72) Inventor: Shane Keng, Marietta, GA (US)

( * ) Notice: Subject to any disclaimer, the term of this patent is extended or adjusted under 35 U.S.C. 154(b) by 211 days.

(21) Appl. No.: 15/184,022

(22) Filed: Jun. 16, 2016

(65) Prior Publication Data

US 2017/0043469 A1 Feb. 16, 2017

Related U.S. Application Data

(60) Provisional application No. 62/205,161, filed on Aug. 14, 2015.

(51) Int. Cl.

| | |
|---|---|
| ***B25G 1/08*** | (2006.01) |
| ***B25F 1/02*** | (2006.01) |
| ***F41G 1/54*** | (2006.01) |
| ***F41A 11/00*** | (2006.01) |
| ***F41A 35/00*** | (2006.01) |

(52) U.S. Cl.

CPC ..... *B25F 1/02* (2013.01); *B25G 1/08* (2013.01); *F41A 11/00* (2013.01); *F41A 35/00* (2013.01); *F41G 1/545* (2013.01)

(58) Field of Classification Search

CPC .. B25F 1/02; B25G 1/08; B25G 1/085; B25G 1/102; B25B 13/56; B25B 15/008; F41A 11/00; F41A 35/00; F41G 1/545

See application file for complete search history.

(56) References Cited

U.S. PATENT DOCUMENTS

| | | | | |
|---|---|---|---|---|
| 3,683,984 | A * | 8/1972 | Hull | B25G 1/085 81/177.4 |
| 7,021,181 | B1 * | 4/2006 | Chi | B25G 1/085 81/177.1 |
| 7,637,049 | B1 * | 12/2009 | Samson | F41A 35/00 42/107 |
| 2002/0007705 | A1 * | 1/2002 | Beauchamp | B25G 1/085 81/490 |
| 2004/0065178 | A1 * | 4/2004 | Anderson | B25B 23/12 81/177.4 |
| 2016/0214239 | A1 * | 7/2016 | Jiang | B25G 1/085 |

* cited by examiner

*Primary Examiner* — Robert J Scruggs
(74) *Attorney, Agent, or Firm* — Eversheds Sutherland (US) LLP

(57) ABSTRACT

A handheld tool is disclosed herein. The tool may include a central member comprising a first and second end. The tool also may include a plurality of storage pockets disposed within the central member about the first end of the central member. The storage pockets may be configured to store one or more tool accessories therein. The tool also may include a forward member comprising a first and second end. The second end of the forward member may be attachable to the first end of the central member. The tool may include a recessed attachment point disposed on the first end of the forward member. In some instances, the tool accessories may be attachable to the recessed attachment point. The tool may include a rear member comprising a first and second end. The first end of the rear member may be attachable to the second end of the central member.

19 Claims, 3 Drawing Sheets

MULTIPURPOSE HANDHELD TOOL AND ACCESSORIES

CROSS-REFERENCE TO RELATED APPLICATIONS

The disclosure claims priority to and the benefit of U.S. provisional patent application No. 62/205,161, filed Aug. 14, 2015, which is incorporated by reference herein in its entirety.

FIELD OF THE DISCLOSURE

The disclosure generally relates to handheld tools and more particularly relates to multipurpose handheld tools and accessories.

BACKGROUND

The proper operation of a firearm is of critical importance. Unfortunately, a variety of firearm malfunctions can occur that render the firearm useless until repairs can be performed, and these repairs typically include the use of proper tools. In view of the importance of performing necessary repairs on an inoperative firearm, it would be beneficial to have ready and useful access to proper tools suitable for correcting firearm malfunctions.

SUMMARY

Some or all of the above needs and/or problems may be addressed by certain embodiments of the handheld tool disclosed herein. According to an embodiment, the tool may include a central member comprising a first end and a second end. The tool also may include a plurality of storage pockets disposed within the central member about the first end of the central member. The plurality of storage pockets may be configured to store one or more tool accessories therein. The tool also may include a forward member comprising a first end and a second end. The second end of the forward member may be attachable to the first end of the central member. The tool may include a recessed attachment point disposed on the first end of the forward member. In some instances, the one or more tool accessories may be attachable to the recessed attachment point. The tool may include a rear member comprising a first end and a second end. The first end of the rear member may be attachable to the second end of the central member.

Other features and aspects of the handheld tool will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
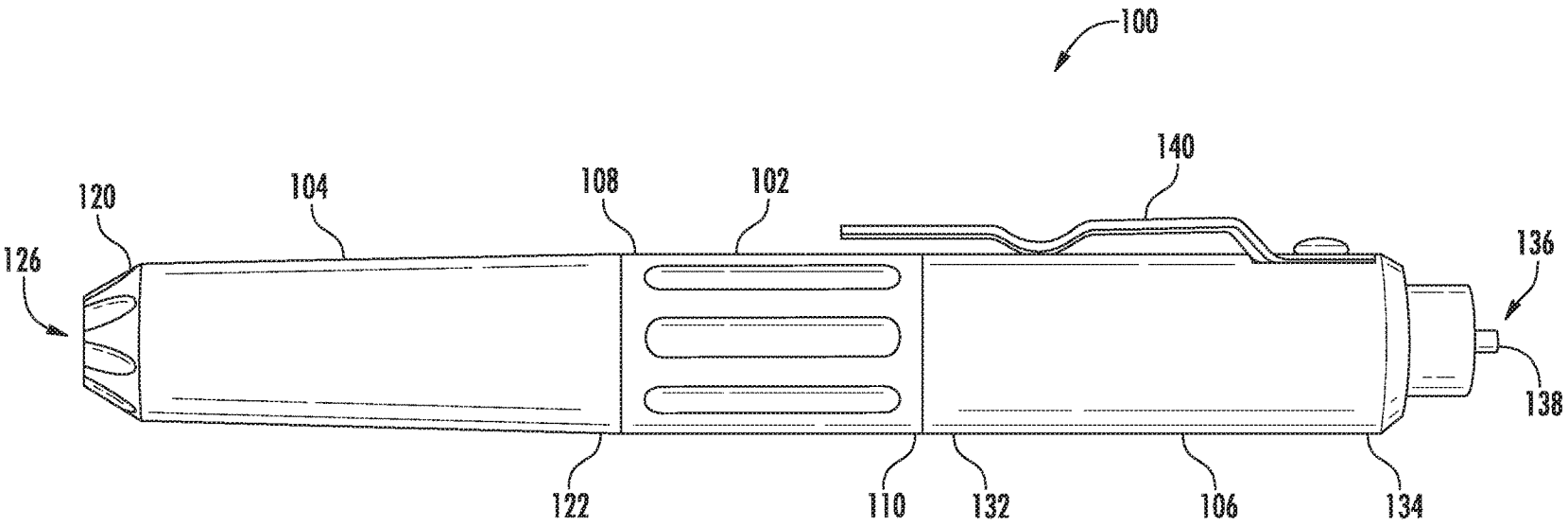
FIG. 1 depicts a handheld tool in accordance with one or more embodiments of the disclosure.
Figure 2:
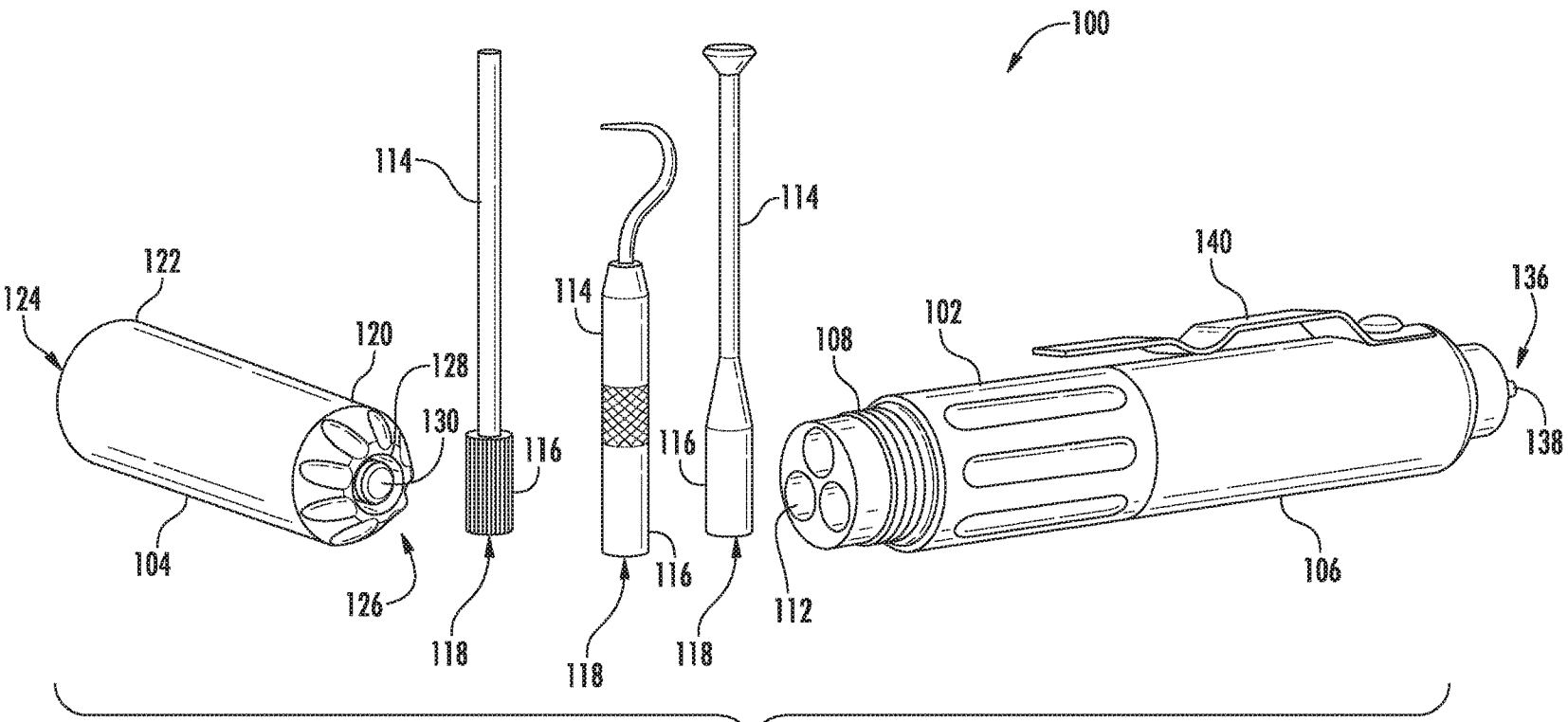
FIG. 2 depicts a handheld tool in accordance with one or more embodiments of the disclosure.
Figure 3:
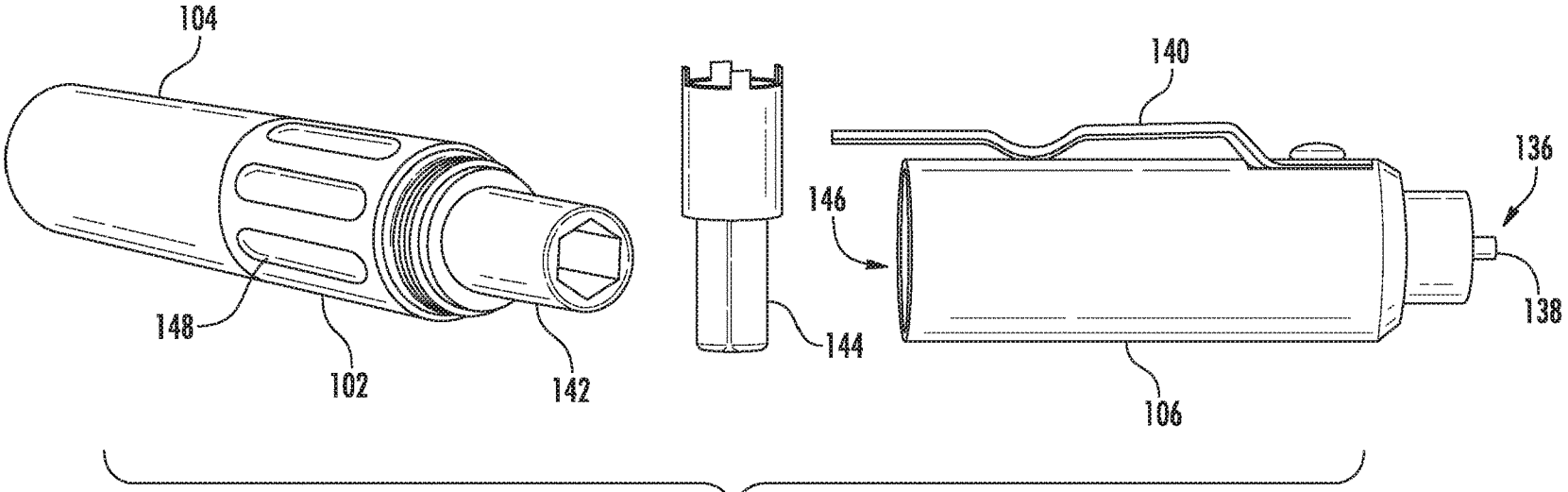
FIG. 3 depicts a handheld tool in accordance with one or more embodiments of the disclosure.

FIGS. 1-3 depict a handheld tool 100. The tool 100 may be used for any suitable purpose. In some instances, the tool 100 may comprise a multipurpose handheld tool with accessories for use with a firearm or the like. The tool 100 may be modular. For example, the tool 100 may include a central member 102, a forward member 104, and a rear member 106. The central member 102, the forward member 104, and the rear member 106 may collectively form the body of the tool 100. For example, the central member 102, the forward member 104, and the rear member 106 may be attached to one another to form an elongated, cylindrical, pen-like structure that can be held in the hand of a user. The tool 100 may be any suitable shape and/or size.

The central member 102 may include a first end 108 and a second end 110. The first end 108 and the second end 110 of the central member 102 may include threads or the like. Any attachment means may be used herein. The central member 102 may include a plurality of storage pockets 112. In some instances, the storage pockets 112 may be disposed within the central member 102 about the first end 108 of the central member 102. The storage pockets 112 may comprise elongated tubular cavities with an opening at one end. The storage pockets 112 may extend into the central member 102 from the first end 108. The longitudinal axis of the storage pockets 112 may be parallel to the longitudinal axis of the assembled tool 100. The storage pockets 112 may extend any suitable depth into the central member 102. The storage pockets 112 may be any size, shape, and/or configuration. Although three storage pockets 112 are shown, any number of storage pockets 112 may be disposed within the central member 102.

The storage pockets 112 may be configured to at least partially house one or more tool accessories 114 therein. For example, the tool accessories 114 may be at least partially disposed within the storage pockets 112 of the assembled tool 100. In this manner, the tool accessories may be securely stored within the assembled tool 100 and accessed as needed by at least partially disassembling the tool 100. The tool accessories 114 may include various tools, including, but not limited to, a hook, a rod, and/or a piston. Any type of suitable tool may be used herein. Each of the tool accessories 114 may include a base member 116 having a threaded cavity 118 at an end thereof. In some instances, the tool accessories 114 may be slid into the storage pockets 112 on the base member 116 side first. The tool accessories 114 may be disposed within the storage pockets 114 in any suitable manner.

The forward member 104 may include a first end 120 and a second end 122. The second end 122 of the forward member 104 may be attachable to the first end 108 of the central member 102. In some instances, the second end 122 of the forward member 104 may be screwed onto the first end 108 of the central member 102. Any suitable attachment means may be used herein. In some instances, the second end 122 of the forward member 104 may include an internal cavity 124. The cavity 124 may extend into the forward member 104 from an opening in the second end 122 of the forward member 104. The first end 108 of the central member 102 may include a reduced diameter with exterior threads thereon that are screwed into corresponding interior threads on the second end 122 of the forward member 104 within the cavity 124. In some instances, the cavity 124 may enclose the tool accessories 114 disposed within the storage pockets 112 when the second end 122 of the forward member 104 is attached to the first end 108 of the central member 102. In this manner, the tool accessories 114 may be stored within the storage pockets 112 and secured therein by the forward member 104 when the second end 122 of the forward member 104 is attached to the first end 108 of the central member 102.

The forward member 104 may include a recessed attachment point 126 disposed on the first end 120 thereof. In this manner, the tool accessories 114 may be attachable to the recessed attachment point 126. For example, the recessed attachment point 126 may comprise a cavity 128 with a threaded protrusion 130 positioned therein. The threaded cavity 118 within the base member 116 of each tool accessory 114 may be attached to the recessed attachment point 126. That is, the threaded cavity 118 within the base member 116 of each tool accessory 114 may mate with the threaded protrusion 130 within the cavity 128 at the first end 120 of the forward member 104 such that at least a portion of the base member 116 is disposed within the cavity 128. In some instances, only one of the tool accessories 114 may be attached to the recessed attachment point 126 at a time. The longitudinal axis of the tool accessories 114 may be aligned with or parallel to the longitudinal axis of the assembled tool 100 when the tool accessories are attached to the recessed attachment point 126.

The rear member 106 may include a first end 132 and a second end 134. The first end 132 of the rear member 106 may be attachable to the second end 110 of the central member 102. For example, first end 132 of the rear member 106 may be screwed onto the second end 110 of the central member 102. Any suitable attachment means may be used herein. In some instances, a tool attachment device 142 may be disposed at the second end 110 of the central member 102. For example, the tool attachment device 142 may extend from the second end 110 of the central member 102. In some instances, the tool attachment device 142 may comprise a hex shank or the like for mating with one or more hex bits 144. In such instances, the first end 132 of the rear member 106 may comprise an internal cavity 146 that encloses the tool attachment device 142 and/or bit 144 attached thereto when the first end 132 of the rear member 106 is attached to the second end 110 of the central member 102. The cavity 146 may extend into the rear member 106 from an opening in the first end 132 of the rear member 106. In this manner, the tool attachment device 142 and/or bit 144 attached thereto may be disposed within the cavity 146 and secured therein by the rear member 106 when the first end 132 of the rear member 106 is attached to the second end 110 of the central member 102. The second end 110 of the central member 102 may include a reduced diameter with exterior threads thereon that are screwed into corresponding interior threads on the first end 132 of the rear member 106 within the cavity 146.

In some instances, an enhanced gripping surface 148 may be disposed about the central member 102. The enhanced gripping surface 148 may comprise elongated grooves on an exterior of the central member 102. In addition, a firearm sight adjustment tool 136 may be disposed on the second end 134 of the rear member 106. The firearm sight adjustment tool 136 may include two protrusions 138. The firearm sight adjustment tool 136 may comprise an AIMPOINT® adjustment tool or the like. Moreover, a clip 140 may be attached to the rear member 106.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A handheld tool, comprising:

a central member comprising a first end and a second end;

a plurality of storage pockets disposed within the central member about the first end of the central member, wherein the plurality of storage pockets are configured to at least partially house one or more tool accessories therein, the one or more tool accessories comprising a first cavity, wherein the first cavity is threaded;

a forward member comprising a first end and a second end, wherein the second end of the forward member is attachable to the first end of the central member;

a recessed attachment point comprising a second cavity with a threaded protrusion therein, the recessed attachment point disposed on the first end of the forward member, wherein the one or more tool accessories are attachable onto the threaded protrusion of the recessed attachment point via the first cavity; and a rear member comprising a first end and a second end, wherein the first end of the rear member is attachable to the second end of the central member.

2. The tool of claim 1, further comprising a firearm sight adjustment tool disposed on the second end of the rear member.

3. The tool of claim 1, further comprising a clip attached to the rear member.

4. The tool of claim 1, further comprising a socket disposed at the second end of the central member.

5. The tool of claim 4, wherein the first end of the rear member comprises a third cavity that encloses the socket when the first end of the rear member is attached to the second end of the central member.

6. The tool of claim 1, wherein the second end of the forward member comprises a fourth cavity that encloses the one or more tool accessories when the second end of the forward member is attached to the first end of the central member.

7. The tool of claim 1, further comprising an enhanced gripping surface disposed about the central member.

8. A handheld tool, comprising:

a central member comprising a first end and a second end;

a plurality of storage pockets disposed within the central member about the first end of the central member, wherein the plurality of storage pockets are configured to at least partially house one or more tool accessories therein, the one or more tool accessories comprising a first cavity, wherein the first cavity is threaded;

a forward member comprising a first end and a second end, wherein the second end of the forward member is attachable to the first end of the central member;

a recessed attachment point disposed on the first end of the forward member, wherein the recessed attachment point comprises a second cavity with a threaded protrusion therein, wherein the one or more tool accessories are attachable onto the recessed attachment point via the first cavity; and a rear member comprising a first end and a second end, wherein the first end of the rear member is attachable to the second end of the central member.

9. The tool of claim 8, further comprising a firearm sight adjustment tool disposed on the second end of the rear member.

10. The tool of claim 8, further comprising a clip attached to the rear member.

11. The tool of claim 8, further comprising a socket disposed at the second end of the central member.

12. The tool of claim 11, wherein the first end of the rear member comprises a third cavity that encloses the socket when the first end of the rear member is attached to the second end of the central member.

13. The tool of claim 8, wherein the second end of the forward member comprises a fourth cavity that encloses the one or more tool accessories when the second end of the forward member is attached to the first end of the central member.

14. The tool of claim 8, further comprising an enhanced gripping surface disposed about the central member.

15. A handheld tool, comprising:

a central member comprising a first end and a second end;

a plurality of storage pockets disposed within the central member about the first end of the central member, wherein the plurality of storage pockets are configured to at least partially house one or more tool accessories therein, the one or more tool accessories comprising a threaded cavity;

a forward member comprising a first end and a second end, wherein the second end of the forward member is attachable to the first end of the central member;

a recessed attachment point disposed on the first end of the forward member, wherein the recessed attachment point comprises a second cavity with a threaded protrusion therein, wherein the one or more tool accessories are attachable to the recessed attachment point via the first cavity;

a rear member comprising a first end and a second end, wherein the first end of the rear member is attachable to the second end of the central member;

a firearm sight adjustment tool disposed on the second end of the rear member; and a clip attached to the rear member.

16. The tool of claim 15, further comprising a socket disposed at the second end of the central member.

17. The tool of claim 16, wherein the first end of the rear member comprises a third cavity that encloses the socket when the first end of the rear member is attached to the second end of the central member.

18. The tool of claim 15, wherein the second end of the forward member comprises a fourth cavity that encloses the one or more tool accessories when the second end of the forward member is attached to the first end of the central member.

19. The tool of claim 15, further comprising an enhanced gripping surface disposed about the central member.

* * * * *